United States Patent [19]

Salzmann

[11] 3,951,195

[45] Apr. 20, 1976

[54] DRAPERY ROD AND BRACKETS

[75] Inventor: Ferdinand F. Salzmann, Middleton, Wis.

[73] Assignee: Consolidated Foods Corporation, Chicago, Ill.

[22] Filed: May 2, 1975

[21] Appl. No.: 574,105

[52] U.S. Cl. ..... 160/345; 16/87.4 R; 16/94 D

[51] Int. Cl.[2] ..... A47H 1/10; A47H 5/032

[58] Field of Search .....160/344–347, 123–124, 126; 16/87–87.8, 94 D, 95 D, 96 D

[56] References Cited

UNITED STATES PATENTS

| | | | |
|---|---|---|---|
| 3,333,622 | 8/1967 | Graber | 160/345 |
| 3,345,678 | 10/1967 | Graber et al. | 160/345 X |
| 3,653,091 | 4/1972 | McKenna et al. | 160/345 X |

*Primary Examiner*—Philip C. Kannan
*Attorney, Agent, or Firm*—Morsbach & Pillote

[57] ABSTRACT

A hollow drapery rod having a decorative face at the top, front and bottom, a trackway at the rear side, and a pulley housing inwardly of the end of the rod. The rod has bracket receiving openings in the top and bottom adjacent the pulley housing and the rod support bracket has a U-shaped saddle with one leg underlying the bottom of the rod and an upwardly extending leg extending through the bracket receiving opening of the bottom of the rod and through the rod and out through the bracket receiving opening in the top of the rod to firmly support and position the rod. The pulley housing has wall portions engaged by the upwardly extending leg on the support bracket to be anchored thereby and the wall portions of the pulley housing aid in guiding the upwardly extending leg on the bracket through the rod and out of the bracket receiving opening in the top of the rod to facilitate installation of the rod on the bracket.

10 Claims, 5 Drawing Figures

28
3
11
12
15
14
10
15
3
16
13

21
24a
21c
32c
12
24
39
25
40
32
25a
13

32c
21b
21
42
43
11
10
21a
5
31a
41
41a
32a
39
4
4
24
22
44
26
46a
25
31
32
46
12
31b
45
5
23
32b
41b 10
22
38
33
31
34
39
23
40
46
46a
11
51
32
32b
25
10

21c
11
46a
10
21
32
32c
24
39
26
46
25
34
40
23
38
12
33
44

DRAPERY ROD AND BRACKETS

BACKGROUND OF THE INVENTION

This invention relates to traverse rods of the type having a decorative face at the top, front and bottom with a trackway at the rear and having a pulley housing inwardly of the end of the rod for guiding the traverse cords into and out of the rod. The rod and pulley housing are subject to substantial forces in a direction lengthwise as well as crosswise of the rod, when the draw cords are pulled to open and close the draperies, and various different bracket arrangements have heretofore been utilized to support the rod and the pulley housing in the rod. In some rod and bracket arrangements, for example as shown in the U.S. Pat. to Graber, No 3,333,622, the rod brackets included an upwardly opening saddle that engaged the rear, bottom and front walls of the rod with a prong on the saddle extending upwardly through an opening in the bottom of the rod to hold the rod against endwise movement. Such brackets were objectionable in some rod installations because they obscured a portion of the front or face wall of the rod and, moreover, tended to mar the surface finish of the rod during insertion and removal of the rod from the bracket. In other rod and bracket arrangements, for example as shown in U.S Pat. to Graber et al, No. 3,470,578, the rod bracket engaged a mounting rail on the rear side of the rod above the trackway so that the rod bracket was not exposed at the front of the rod. However, this required a special rod having a mounting rail at its rear side above the trackway and, moreover, the rod brackets did not directly engage the pulley housing to hold the same against movement relative to the rod.

SUMMARY OF THE INVENTION

Various important objects of this invention are to provide a traverse rod, pulley housing and mounting bracket assembly in which the mounting bracket directly engages and positively supports the rod against both endwise shifting and turning movement about its lengthwise axis; in which the rod bracket directly engages the pulley housing positioned in the rod to anchor the pulley housing against movement in a direction lengthwise of the rod; in which the rod bracket does not overlie or contact the face of the rod; and which allows easy installation and removal of the rod and pulley housing from the mounting bracket.

The traverse rod of the present invention has a face wall at the top, front and bottom and a trackway at the rear side and a pulley housing positioned inwardly at the end of the rod. Top and bottom bracket receiving openings are formed in the top and bottom walls of the rod and the mounting bracket has one leg that underlies and supports the rod and an upwardly extending leg that extends through the bottom opening and through the hollow rod and into the top opening to longitudinally and angularly position the rod. The pulley housing has a wall portion that engages the upwardly extending leg on the bracket internally of the rod to anchor the pulley housing directly to the rod and the walls of the pulley housing are arranged to aid in guiding the upwardly extending leg on the bracket through the hollow rod and into the top opening during installation of the rod onto the bracket.

These, together with other objects, advantages and features of this invention will be more readily appreciated as the invention becomes better understood by reference to the following detailed description when taken in connection with the accompanying drawings wherein.

Figure 1:
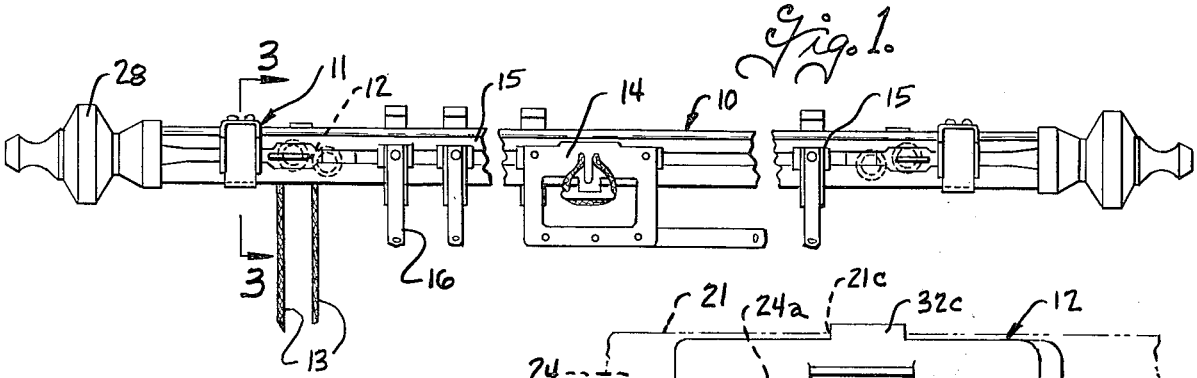
FIG. 1 is a rear elevational view of a rod, pulley housing and end bracket construction embodying the present invention.
Figure 2:
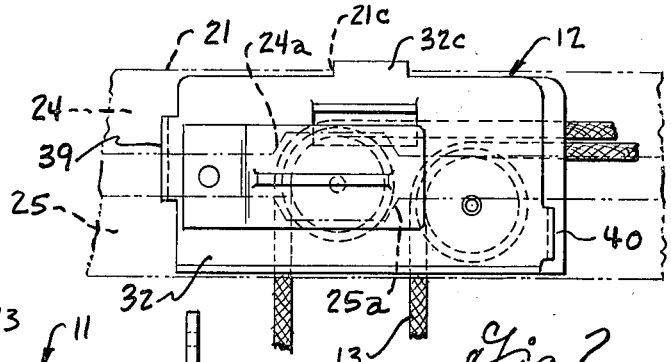
FIG. 2 is a rear elevational view of the pulley housing with the rod shown in phantom.

The traverse rod illustrated in FIG. 1 in general includes an elongated rod 10 which is supported adjacent opposite ends by end support brackets 11 and, where required in longer rods, by one or more intermediate brackets (not shown). Cord guide pulley assemblies 12 are mounted inside the rod 10 and have a traverse cord 13 threaded thereover and connected to a master slide 14 for moving the same along the rod. In the embodiment shown, only one master slide is illustrated, as is suitable for one-way traverse operation, it being understood that a pair of master slides can be provided and connected to the traverse cord 13 for movement in relatively opposite directions toward and away from the center of the rod in a manner well known in the art for two-way traverse operation. A plurality of auxiliary sliders 15 are mounted in the rod and have drapery support pendents 16 for supporting the drapery thereon.

The rod 10 may be formed in any suitable way as by rolling a strip of stock into the desired shape or by extrusion. The rod has a face wall of generally U-shaped cross section and a trackway at the rear. In the embodiment illustrated, the rod has a generally rectangular cross section including top, front and bottom wall portions 21–23 respectively and upper and lower rear wall portions 24 and 25 at the rear side of the rod which are spaced apart to define a trackway 26 therebetween extending lengthwise of the rod, preferably all the way to the ends of the same. As is conventional, the rod may be formed in two or more telescopically interconnected sections to enagle adjustment of the length of the rod for different sized windows. In order to facilitate attachment of intermediate support brackets to the rod, the top wall of the rod is formed with a reentrant channel 21*a* that extends lengthwise of the rod forwardly of the rear wall, and a rearwardly extending rib 21*b* adjacent the rear edge of the top wall.

The support brackets 11 are arranged to engage the rod at a point inwardly of the ends of the rod to provide an overhang beyond the end brackets, and end finials 28 are detachably mounted on the ends of the rod. For example, the end finials may be formed with a socket dimensioned to receive the end of the rod so the finials may be pressed on to the end of the rod to mount the same.

The pulley housing 12 includes front and rear walls 31 and 32 and one or more cord guide pulleys 33 disposed between the front and rear walls and rotatably supported on pins or axles 34. The rear wall 32 of the pulley housing is dimensioned to extend between the top and bottom wall portions 21 and 23 of the rod to vertically locate the pulley housing in the rod and to support the top and bottom wall portions in spaced relation, and the rear wall of the pulley housing has upper and lower rearwardly extending flanges 32*a* and 32*b* arranged to engage the rear wall portions 24 and 25 of the rod to space the pulley housing forwardly from the rear wall of the rod. The front wall 31 of the pulley housing has upper and lower flanges 31*a* and 31*b* which extend forwardly into engagement with the front wall 22 of the rod to sapce the pulley housing from the front wall. The rod has a cord receiving opening 38, which cord receiving opening has a width measured transverse to the rod approximating the spacing between the front and rear walls 31 and 32 of the pulley housing, and a length lengthwise of the rod which is less than the length of the pulley housing and sufficient to allow the cords to pass downwardly from the rod. The rear wall 32 of the pulley housing has an upwardly extending projection 32*c* on the upper edge thereof and the top wall of the rod is formed with a slot 21*c* dimensioned to register with and receive the projection 32*c* when the pulley housing is in proper position relative to the cord opening 38, to thereby longitudinally position the pulley housing in the rod. The rod is formed of material such as sheet metal which is sufficiently resilient to allow spreading of the top and bottom wall portions of the rod to accommodate the projection 32*c* on the pulley housing during endwise insertion of the pulley housing into the rod, until the projection registers with the opening 21*c* and allows the top wall to move downwardly into engagement with the upper edge of the rear wall 32 of the pulley housing. A generally upright transverse wall portion 39 extends between and interconnects the front and rear wall portions 31 and 32 of the pulley housing adjacent one end thereof and a transverse wall portion 40 extends from the rear wall 32 forwardly into engagement with the front wall of the pulley housing to maintain the same in proper spaced relation.

Figure 3:
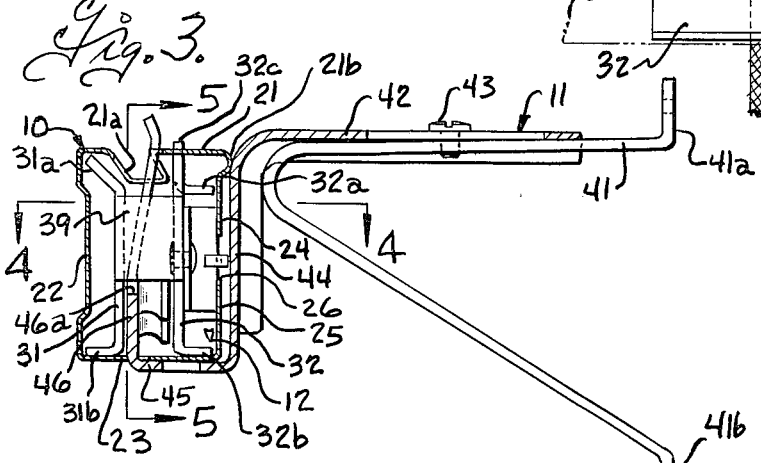
FIG. 3 is a transverse sectional view through the rod, pulley housing and support bracket taken on the plane 3—3 of FIG. 1.
Figure 4:
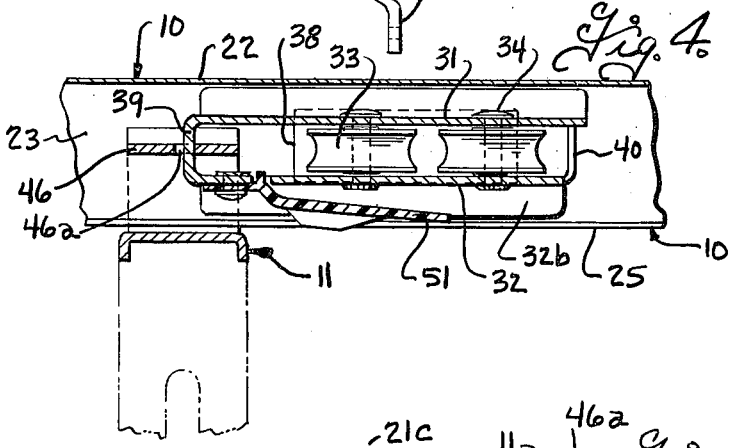
FIG. 4 is a fragmentary horizontal sectional view through the rod, pulley housing and support bracket, taken on the plane 4—4 of FIG. 3.
Figure 5:
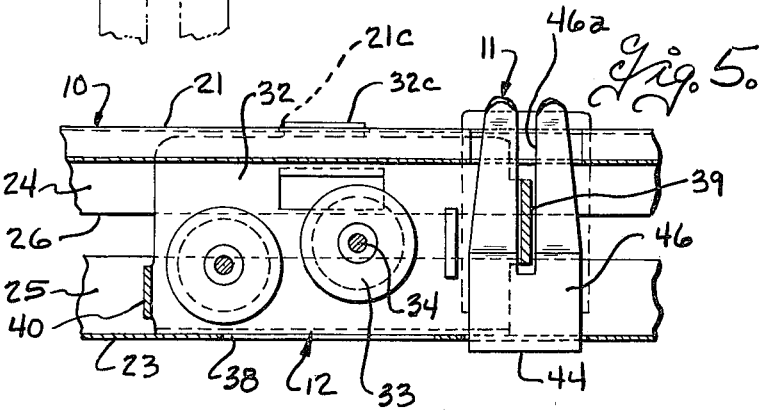
FIG. 5 is a fragmentary vertical sectional view through the rod and pulley housing taken on the plane 5—5 of FIG. 3.

The bracket 11 is of the drop-in type to allow installation and removal of the rod by merely dropping it into the bracket and the bracket includes a wall engaging member 41 having flanges 41*a* and 41*b* adapted for attachment to a supporting surface, and an arm 42 which is adjustably attached to the wall engaging member as by a fastener 43. A saddle is provided at the forward end of the arm 42 and includes a downwardly extending rear leg 44 adapted to extend downwardly along the rear side of the rod, a forwardly extending lower leg 45 adapted to underlie and support the rod, and an upwardly extending front leg 46. The rod is formed with top and bottom bracket receiving openings 21*d* and 23*d* in the top and bottom wall portions 21 and 23 respectively and the top and bottom bracket receiving openings are in approximate vertical alignment to receive the upperwardly extending leg 46 on the mounting bracket. The leg 46 is in the form of a generally flat blade having its major dimension in a direction lengthwise of the rod and the bracket receiving openings 21 *d* and 23*d* are in the form of elongated slots in the top and bottom walls of the rod. The bracket receiving openings 21*d* and 23*d* are located in the rod at positions respectively above and below the transverse wall 39 on the pulley housing and the leg 46 of the bracket has a slot 46*a* extending downwardly from its upper end to form a bifurcated upper end on the leg for straddling the transverse wall 39 on the pulley housing. With this arrangement, the upwardly extending leg 46 on the rod bracket extends through the bottom opening 23*d* and through the rod and into the top opening 21*d* to support the rod against endwise movement and also against angular movement about the lengthwise axis. Additionally, the front leg 46 straddles the end wall 39 on the pulley housing and directly supports the pulley housing against endwise movement relative to the bracket. In addition, the transverse wall 39 on the pulley housing engaging in the slot 46*a* on the front leg of the mounting bracket functions to guide the front leg as it is inserted through the rod into the top opening 21*d*. The top and bottom bracket receiving openings are also located intermediate the front and rear walls 31 and 32 of the pulley housing so that the latter also operate as lateral guides for the front leg of the bracket during insertion through the rod. As best shown in FIG. 3, the upper portion of the front leg is angulated rearwardly and is spaced from the rear leg 44 of the bracket a distance approximating the spacing between the opening 21*a* and the rear of the rod so that 46*a* of the bracket presses the upper portion of the rod against the rear leg 44 of the bracket to thereby firmly support the rod with its front face in an upright condition. The reentrant channel 21*a* in the top wall of the rod is advantageously located intermediate the front and rear walls of the pulley housing and the top bracket receiving opening 21*d* is located in the channel, as is best shown in FIG. 3.

In the embodiment illustrated, the rod is formed with a slide gate at the rear side of the pulley housing. For this purpose, the upper and lower rear wall portions 24 and 25 are notched as shown at 24*a* and 25*a* respectively to provide an opening sufficiently large to allow the slides 15 to be withdrawn from the rod, and a resilient gate member 51 is mounted on the pulley housing to normally block the opening. This slide gear arrangement is generally of the form shown in the aforementioned U.S. Pat. to Graber, No. 3,333,622, and reference is hereby made to that patent for a more complete description of the slide gate.

From the foregoing it is noted that the construction of the traverse rod, pulley housing and end bracket and the use of the same will be readily understood. The traverse rods can be easily installed in the end brackets by dropping the traverse rods into the saddle with the front leg 46 of the bracket extending upwardly through the bottom opening 23*d* and through the rod and out through the top opening 21*d* in the top wall of the rod. Since the front leg of the bracket extends through openings in both the top and bottom walls of the rod, it not only positively locks the rod against endwise movement but also positively supports the rod against turning about an axis lengthwise of the rod. Further, the upper portion of the front leg of the saddle is notched to provide a bifurcated upper end that straddles the transverse end wall 39 on the pulley housing to directly anchor the pulley housing against endwise movement relative to the rod and relative to the bracket. Moreover, the transverse wall 39 engages in the slot 46*a* and aids in guiding the front leg through the rod and out to the top opening, and the front and rear walls of the pulley housing also aid in guiding the front leg of the bracket during insertion of the same through the rod.

In the drawing and specification, there has been set forth a preferred embodiment of the invention and, although specific terms are employed, these are used in a generic and descriptive sense only and not for purpose of limitation. Changes in form and proportion of parts as well as substitution of equivalents are contemplated as circumstances may suggest or render expedient, without departing from the spirit or scope of this invention, as further defined in the following claims.

The embodiments of the invention in which an exclusive property or privilege is claimed are defined as follows:

1. In a traverse rod having top, front and bottom wall portions defining a face wall of generally U-shaped cross section and having upper and lower rear wall portions at the rear side of the rod spaced apart to define a trackway therebetween, at least one master carrier and a plurality of auxiliary drapery carriers mounted in the trackway for movement therealong, a pulley housing having cord guide means therein disposed in the rod, a cord opening in the bottom wall of the rod below the pulley housing, traverse cord means connected to said master slide and extending over said cord guide means and through said cord opening, and a rod support bracket for mounting the rod, the improvement comprising: said top and bottom wall portions of said rod respectively having top and bottom bracket receiving openings in approximate vertical alignment and spaced forwardly from the upper and lower rear wall portions, said rod bracket including a generally U-shaped saddle having a rear leg at the rear side of the rod, a lower leg extending forwardly from the rear leg and underlying the bottom wall of the rod, and a front leg extending from the lower leg upwardly through said bracket receiving opening in the bottom wall portion of the rod and through said rod and into said bracket receiving opening in said top wall portion of said rod, said pulley housing having a generally upright transverse wall extending crosswise of the rod, and said front leg on said bracket having means engaging said upright transverse wall on pulley housing at a location intermediate the top and bottom wall portions of the rod to anchor the pulley housing to the bracket.

2. A traverse rod according to claim 1 wherein said front leg on the bracket has a bifurcated upper end straddling said upright transverse wall on the pulley housing.

3. A traverse rod according to claim 2 wherein said pulley housing has spaced front and rear walls and said generally upright wall portion extends between and interconnects the front and rear walls of the pulley housing.

4. A traverse rod according to claim 1 wherein said pulley housing has a rear wall dimensioned to extend from the bottom wall portion to the top wall portion of said rod, said top wall portion of the rod having a slot therein aligned with said rear wall of the pulley housing, said rear wall of the pulley housing having a projection extending above the rear wall of the pulley housing into said slot to position the pulley housing in the rod, said rod being formed of a material sufficiently resilient to allow the top and bottom walls to spring apart and accommodate the projection on the rear wall of the pulley housing during insertion of the pulley housing into the rod.

5. A traverse rod according to claim 1 wherein said pulley housing has front and rear walls spaced apart to receive the cord guide means therebetween and said transverse wall extends between the front and rear walls of the pulley housing and interconnects the same, said top and bottom openings in the top and bottom wall portions of the rod being located intermediate the front and rear walls of the pulley housing, and said upwardly extending leg of the saddle having a bifurcated upper end portion that straddles said end wall on the pulley housing.

6. A traverse rod according to claim 1 wherein said top wall portion of the rod has a longitudinally extending reentrant channel spaced forwardly from said rear wall portion of the rod, said top opening in the top wall being located in said reentrant channel.

7. In a traverse rod having top, front and bottom wall portions defining a face wall of generally U-shaped cross section and having upper and lower rear wall portions at the rear side of the rod spaced apart to define a trackway therebetween, at least one master carrier and a plurality of auxiliary drapery carriers mounted in the trackway for movement therealong, a pulley housing having cord guide means therein disposed in the rod, a cord opening in the bottom wall of the rod below the pulley housing, traverse cord means connected to said master slide and extending over said cord guide means and through said cord opening, and a rod support bracket for mounting the rod, the improvement comprising: said pulley housing having generally upright front and rear walls intermediate the front and rear wall portions of the rod and a generally upright end wall extending transverse to the lengthwise axis of the rod, said top and bottom wall portions of the rod respectively having top and bottom openings at locations intermediate the front and rear walls of the pulley housing and respectively above and below said end wall of the pulley housing, said rod bracket including a rear leg at the rear side of the rod, a lower leg extending forwardly from the rear leg and underlying said bottom wall portion of the rod and a front leg extending upwardly through said bottom opening and through the rod into the top opening, said front leg having a bifurcated upper end portion straddling said end wall of the pulley housing in the rod.

8. A traverse rod according to claim 7 wherein said top wall portion of the rod has a longitudinally extending reentrant channel intermediate said front and rear walls of the pulley housing, said top opening being located in said reentrant channel.

9. A traverse rod according to claim 7 wherein said top wall portion of said rod has a slot aligned with said rear wall of the pulley housing and rear wall of the pulley housing has a projection extending upwardly therefrom into said slot to longitudinally position the pulley housing in the rod.

10. A traverse rod according to claim 7 wherein the upper end of front leg of the bracket is spaced from rear leg a distance approximating the spacing between the upper bracket receiving opening and the rear edge of the top wall portion to press the upper portion of the rod against the rear leg of the bracket.

* * * * *